US007891036B2

(12) United States Patent
Hahn et al.

(10) Patent No.: US 7,891,036 B2
(45) Date of Patent: Feb. 22, 2011

(54) MULTI-FUNCTION POWER WASHER

(75) Inventors: Klaus Karl Hahn, Braselton, GA (US); Charles Keith Long, Seneca, SC (US); Thomas R. Ayers, Hoschton, GA (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 1319 days.

(21) Appl. No.: 11/376,610

(22) Filed: Mar. 14, 2006

(65) Prior Publication Data

US 2006/0254008 A1 Nov. 16, 2006

Related U.S. Application Data

(60) Provisional application No. 60/664,665, filed on Mar. 18, 2005.

(51) Int. Cl.
*A47L 11/283* (2006.01)

(52) U.S. Cl. ..... 15/50.3; 15/29; 15/50.1; 239/722; 239/754

(58) Field of Classification Search ..... 15/24, 15/29, 50.1, 50.3; 239/722, 754, 525, 526, 239/530, 532

See application file for complete search history.

(56) References Cited

U.S. PATENT DOCUMENTS

| | | | | |
|---|---|---|---|---|
| 1,884,871 | A | 10/1932 | Riebel, Jr. | |
| 3,331,090 | A | 7/1967 | Reiber et al. | |
| 3,631,558 | A * | 1/1972 | Kovacevic | 15/50.3 |
| 3,977,602 | A | 8/1976 | Kirch | |
| 4,766,638 | A | 8/1988 | McDowell | |
| 4,903,364 | A | 2/1990 | Long | |
| 5,312,044 | A | 5/1994 | Eaton | |
| 5,421,520 | A | 6/1995 | Simonette et al. | |
| 5,494,414 | A | 2/1996 | Steinhart et al. | |
| 5,538,402 | A | 7/1996 | McKenney | |
| 6,012,645 | A | 1/2000 | Poppitz | |
| 6,295,692 | B1 | 10/2001 | Shideler | |
| 6,497,001 | B2 | 12/2002 | Di Nunzio et al. | |
| 6,695,235 | B2 | 2/2004 | Faller et al. | |
| 6,776,363 | B1 | 8/2004 | Falletta et al. | |
| 6,866,486 | B2 | 3/2005 | Dexter et al. | |
| 6,929,198 | B2 | 8/2005 | Dexter | |
| 6,945,261 | B2 | 9/2005 | Wadsworth et al. | |
| 7,121,484 | B2 | 10/2006 | Daley | |
| 7,198,204 | B2 | 4/2007 | Bennett et al. | |
| 7,217,053 | B2 | 5/2007 | Alexander et al. | |
| 7,308,900 | B2 | 12/2007 | Otterson | |
| 7,472,842 | B2 * | 1/2009 | Gilpatrick et al. | 239/397 |
| 2003/0062430 | A1 | 4/2003 | Cook | |
| 2003/0129065 | A1 | 7/2003 | Hu | |
| 2004/0046044 | A1 | 3/2004 | Bennett et al. | |
| 2004/0140379 | A1 | 7/2004 | Dexter | |
| 2005/0145270 | A1 | 7/2005 | Ray | |
| 2005/0189437 | A1 | 9/2005 | Alexander et al. | |
| 2006/0101606 | A1 | 5/2006 | Gordon et al. | |

(Continued)

*Primary Examiner*—Randall Chin
(74) *Attorney, Agent, or Firm*—Michael Best & Friedrich LLP

(57) ABSTRACT

A power washer is provided with a transport frame, a wash unit and a gun. The wash unit and the gun may be separated from the transport frame to be used in multiple modes. Possible modes include a walk-behind mode, a spray mode and hand wash modes. A quick connection is also provided to make it easier to disconnect and reconnect various components of the power washer.

45 Claims, 14 Drawing Sheets

U.S. PATENT DOCUMENTS

2006/0102212 A1 5/2006 Leasure et al.
2006/0102745 A1 5/2006 Dexter
2006/0108449 A1 5/2006 Sodemann et al.
2006/0130884 A1 6/2006 Liao
2006/0156497 A1 7/2006 Burkholder et al.
2006/0275146 A1 12/2006 Williams
2007/0169796 A1 7/2007 Johnson et al.

* cited by examiner

Fig. 6
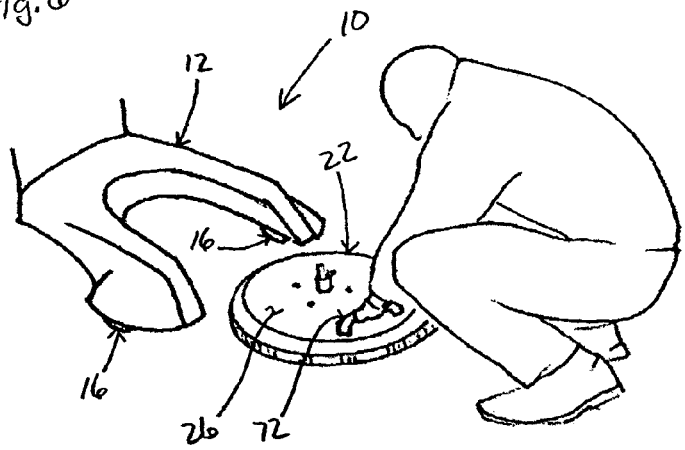
Fig. 7
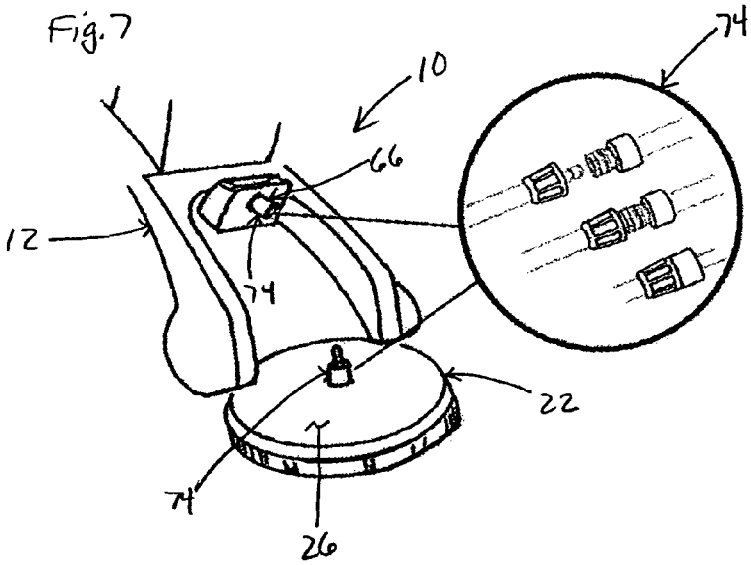
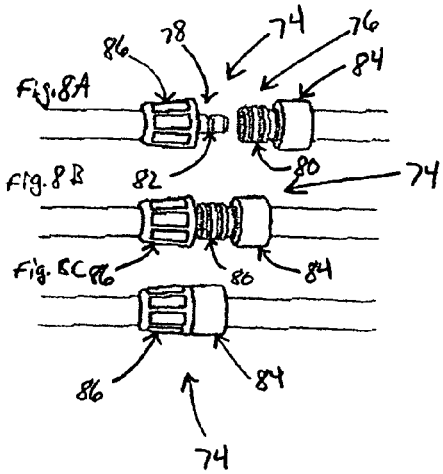

144
146

140
142
30

30
138
72
148
72
14
38
60
60
25
20
50
20
18
136
14
12
146
16
142
30
72
138
16

72
12
164
38
30
150

41
154
160
25
162
29
160
152
156
166
25
29
156
27
156

MULTI-FUNCTION POWER WASHER

This application claims priority to U.S. Provisional Application No. 60/664,665, filed Mar. 18, 2005, which is hereby incorporated by reference herein.

BACKGROUND

The present invention relates generally to a mobile apparatus with a frame and wheels for transporting the apparatus, and more particularly, to a mobile power washer.

Power washers are commonly used to clean a variety of surfaces using high pressure liquid which is sprayed onto a wash surface. Most power washers are used to spray water which may include a cleaning solution or other additives. However, power washers may be used with a number of different liquids and may be used in a variety of applications. Typically, power washers include a frame that is mobile to allow the power washer to be moved easily from place to place. The frame normally supports the fluid pump and the engine, or motor, which powers the pump. Since the pump and the engine are usually relatively heavy, the frame typically includes wheels that allow the frame to be rolled by pushing or pulling on a handle. For example, in one conventional arrangement, the frame is provided with two wheels at the rear end of the frame and two wheels at the forward end of the frame.

Most current power washers are limited in the ways in which the power washer may be used. For example, many power washers are single-use machines equipped with a gun that sprays high pressure fluid from the gun. These types of power washers are commonly used to clean floors or walls by waving the gun toward the wash surface in order to direct high pressure spray at the area being cleaned. However, these devices are generally not designed to be used in different modes of operation and the flexibility of these devices is limited.

Accordingly, it is apparent to the inventors that an improved power washer is needed. As described more fully below, the inventors have devised a number of improvements that may be useful in a variety of power washers.

BRIEF SUMMARY

A mobile power washer is described that may be used in more than one mode of operation. For example, the power washer may be used in a walk behind mode in which the user pushes the handle of the transport frame to move the power washer while the wash unit cleans floor surfaces. The power washer may also be used in a spray mode in which the user waves a gun to direct spray toward the surface being cleaned. The power washer may also be used in a hand wash mode in which the gun is connected to the wash unit through a wand. The power washer may also be used in a vertical hand wash mode in which the gun is directly connected to the wash unit. It is also possible to design the power washer with more or less modes of operation. Additional details are described below.

BRIEF DESCRIPTION OF SEVERAL VIEWS OF THE DRAWINGS

The invention may be more fully understood by reading the following description in conjunction with the drawings, in which:

FIG. 6 is a perspective view of the wash unit being separated from the transport frame of the power washer;

FIG. 7 is a perspective view of the wash unit and the transport frame, showing a quick connection between the wash unit and the transport frame;

FIG. 8A-8C are side elevational views of the quick connection;

FIG. 21 is a perspective view of a power washer with a detergent tank;

DESCRIPTION

Figure 1:
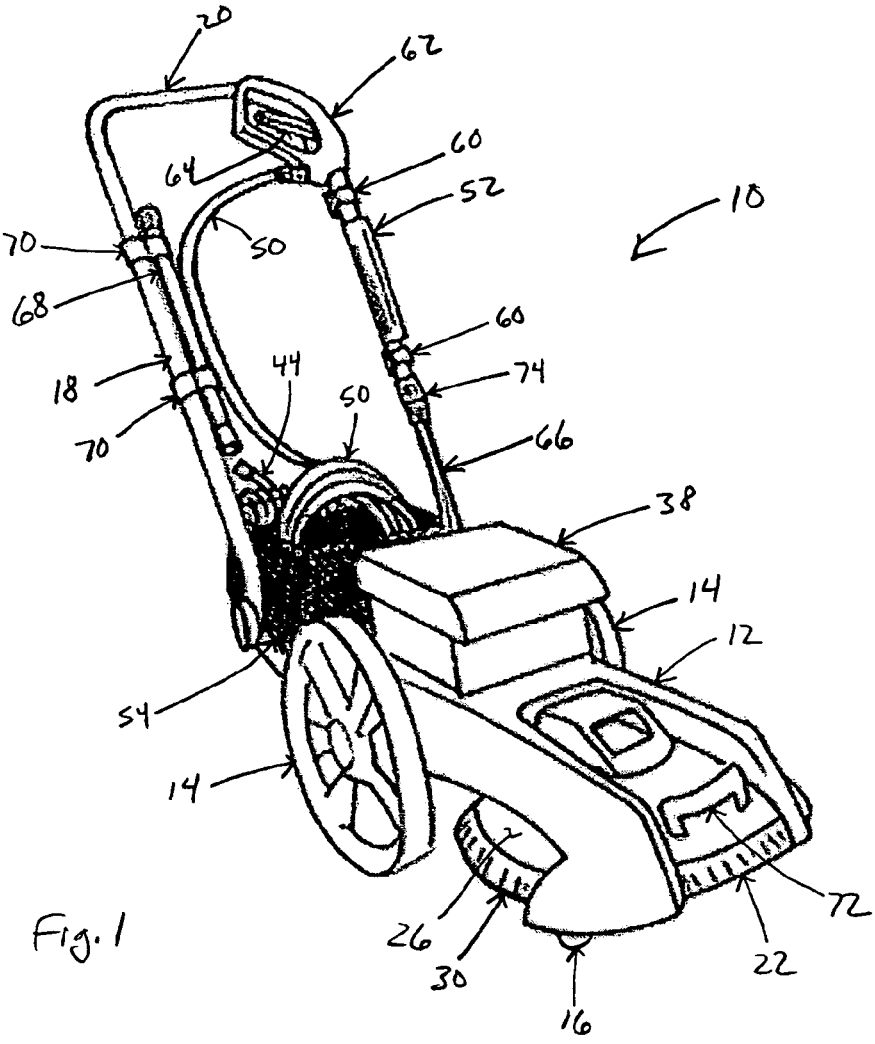
FIG. 1 is a perspective view of one embodiment of a power washer.
Figure 9:
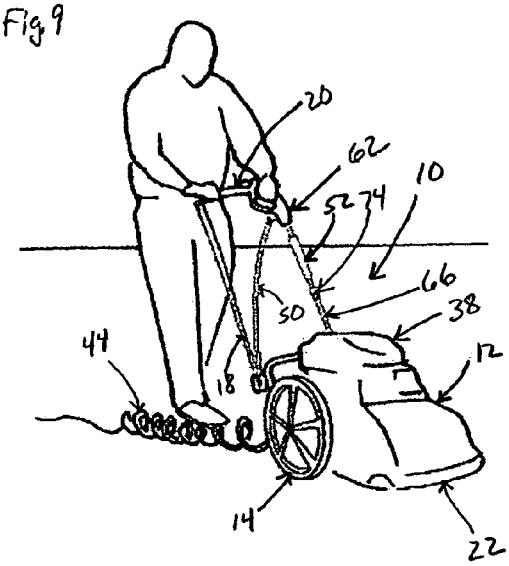
FIG. 9 is a perspective view of the power washer, showing the wash unit being used with the transport frame.
Figure 24:
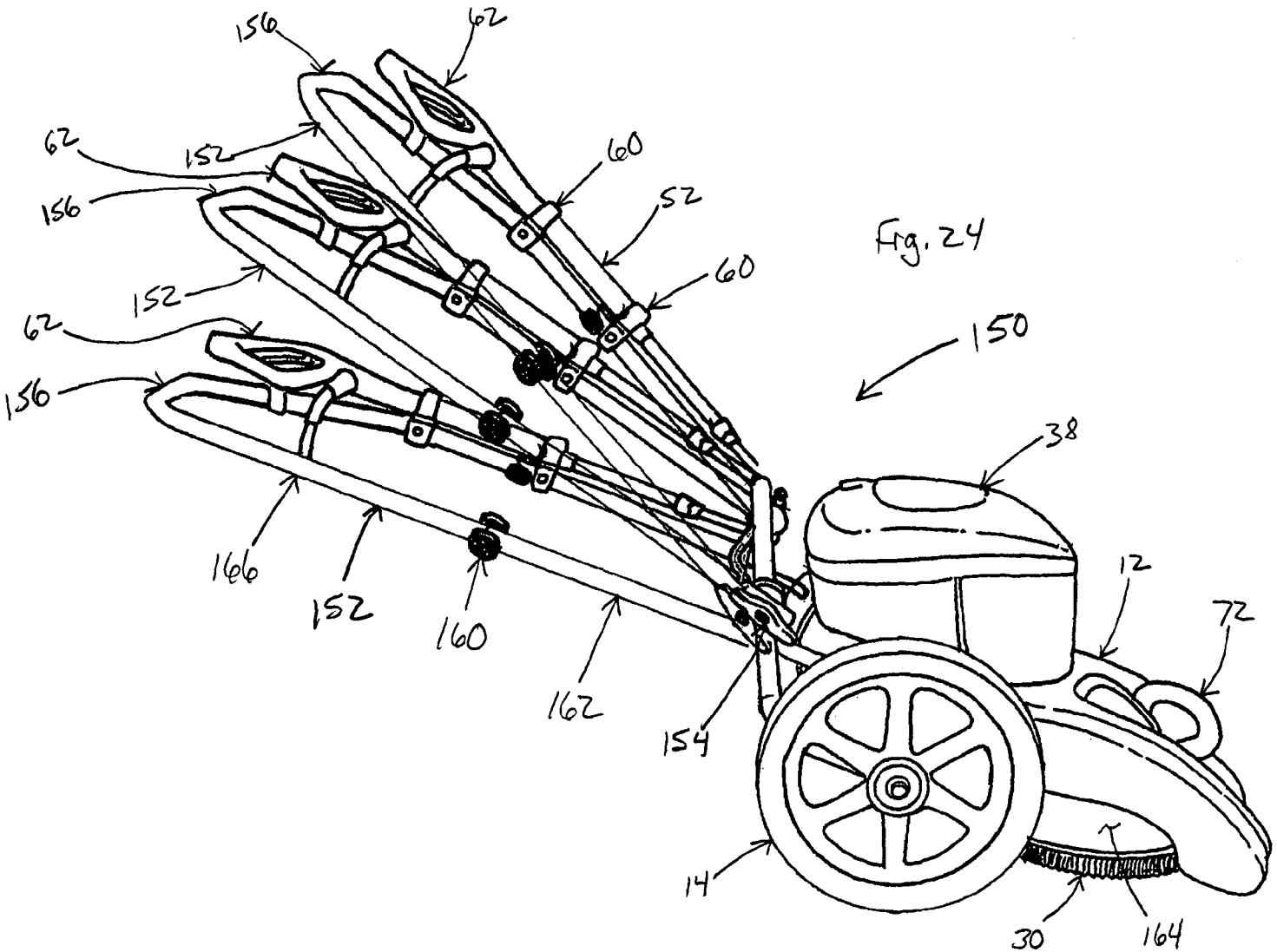
FIG. 24 is a side view of a power washer, showing a height adjustable handle.
Figure 25:
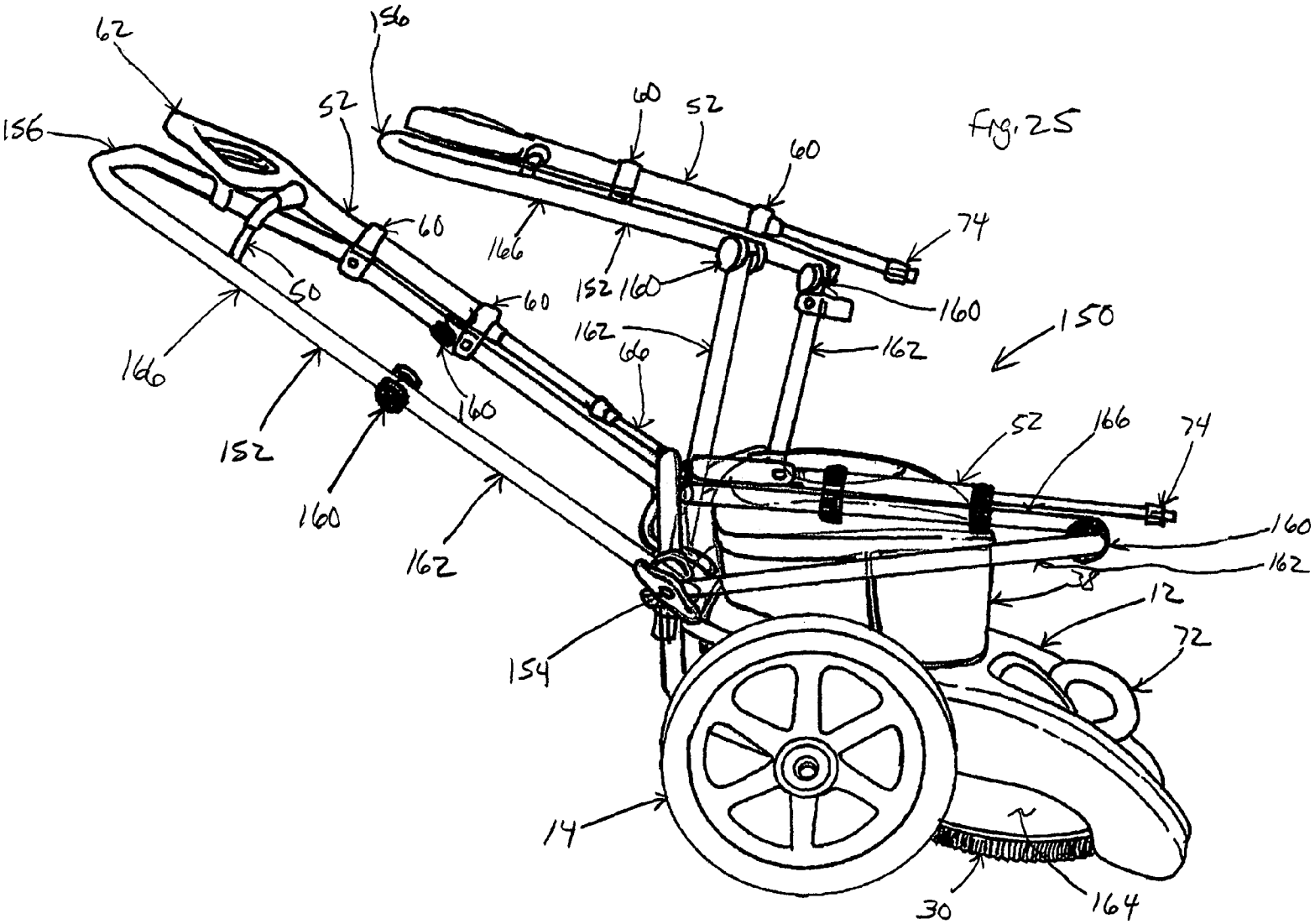
FIG. 25 is a side view of the power washer, showing a double folding handle.

Referring to the drawings, a power washer 10 is shown in FIG. 1 which may be used to clean floors and other surfaces. As described further below, one of the advantages of the power washer 10 is that it may be reconfigured for multiple uses. In general, the power washer 10 includes a transport frame 12 with a pair of rear wheels 14 and a pair of front wheels 16. Preferably, the rear wheels 14 are larger than the front wheels 16 to improve maneuverability of the power washer 10. For example, the rear wheels 14 may be 10" in diameter or larger. This raises the height of the rear axle and generally makes it easier for the operator to maneuver the power washer 10. Preferably the front wheels 16 are casters that freely pivot about a vertical axis. This also improves maneuverability. The front wheels could also be substituted with fixed wheels (height adjustable) or simple feet with wear pads. The transport frame 12 also includes a rearwardly extending handle 18 with a transverse handle grip 20. As shown in FIG. 9, the handle 18 and handle grip 20 are typically used by the operator to push and maneuver the transport frame 12. As shown in FIG. 24, the handle 152 may be height adjustable for different user heights and spacing from the transport frame 12 for better handling during cleaning in the walk-behind mode. As shown in FIG. 25, the handle 152 may also fold with single or double joints 154, 160 to rest over the transport frame 12 for space-saving storage. The fold-mechanism may be a star handle type as sometimes found on lawnmowers or other mechanisms that allow quick-release. The height adjustment may be a push-pin type lock or other means.

Figure 3:
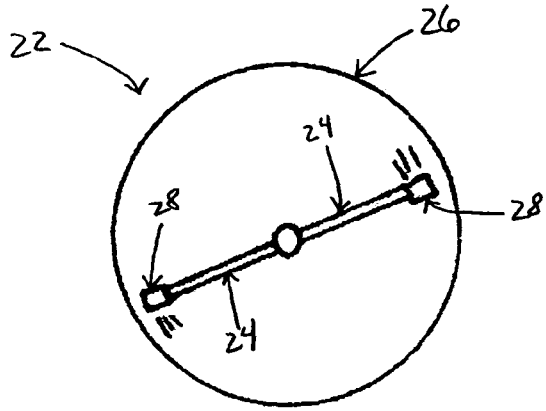
FIG. 3 is a bottom view of the wash unit of the power washer.
Figure 4:
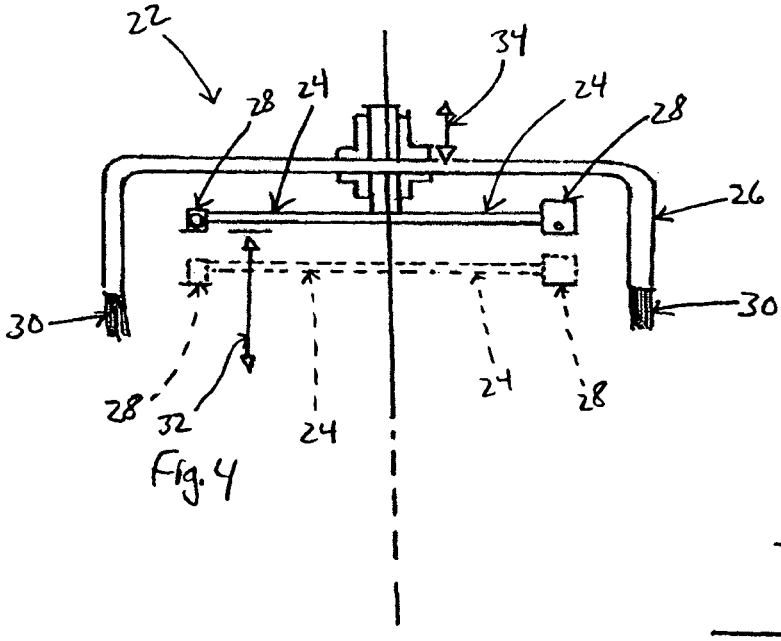
FIG. 4 is a side cross sectional view of the wash unit.
Figure 5:
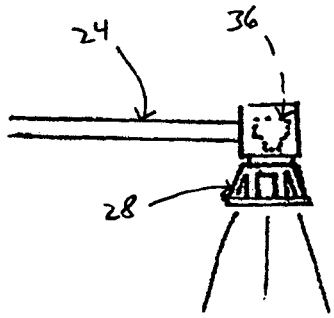
FIG. 5 is a side view of a spray nozzle of the wash unit.

The power washer 10 also includes a wash unit 22. A variety of different types of wash units 22 may be used. For example, as shown in FIGS. 3-4, the wash unit may have a rotating spray bar. As shown in FIGS. 15-20B, the wash unit may also have a fixed spray bar 110 with two or more nozzles 118 attached at specified distances facing toward the floor at an angle. The spray bar may also be height adjustable. As shown in FIGS. 17A-20B, the wash unit may also have roller scrubbing brushes or disk type rotating brushes or a combination of one or more cleaning structures. The brushes may be driven by a gear and/or belt system connected to the drive shaft of the engine or motor or may be self-propelled using water pressure or the push-motion of the power washer 10. The brushes may also be quick-removable for easy changing when they are worn out. In general, wash units 22 are used to clean various surfaces by dispensing a fluid onto the surface either at high pressure through a nozzle or through a scrubbing brush or other dispensing structure. As shown in FIGS. 3 through 5, the wash unit 22 may include a rotating spray bar 24. In general, a spray diameter of about 10" to 32" is preferred. The spray bar 24 may be mounted within a cover 26 so that the spray bar 24 is positioned generally parallel to the surface to be washed. High pressure nozzles 28 are positioned at opposing ends of the spray bar 24 to dispense fluid downward toward the surface being washed. Although a single spray bar 24 with two opposing nozzles 28 is shown, it should be understood that other variations with multiple spray bars and numerous nozzles are possible. As shown in FIG. 4, a skirt 30 may be provided around the bottom edge of the cover 26 to contact the surface being washed. This keeps the spray fluid inside of the cover 26 during washing to prevent overspray. Preferably, the skirt 30 is made of brush fibers, elastomer or the like. The position of the spray bar 24 may also be vertically adjustable relative to the cover 26 as shown by the vertical arrow 32 in FIG. 4. This allows the distance between the spray bar 24 and the wash surface to be adjusted to increase or decrease spray intensity. In addition, as shown by the top vertical arrow 34 in FIG. 4, the position of the cover 26 may be vertically adjusted. This allows the bottom edge of the cover 26 and the spray bar 24 to be positioned closer or farther away from the wash surface as desired. As shown in FIG. 5, quick couplers 36 may be provided for the spray nozzles 28 in the wash unit 22. The quick couplers 36 may be provided with different spray patterns and different spray angles from the wash surface. As a result, the operator may easily change the spray pattern or spray angle without time consuming disassembly and reassembly of the nozzle components.

Figure 2:
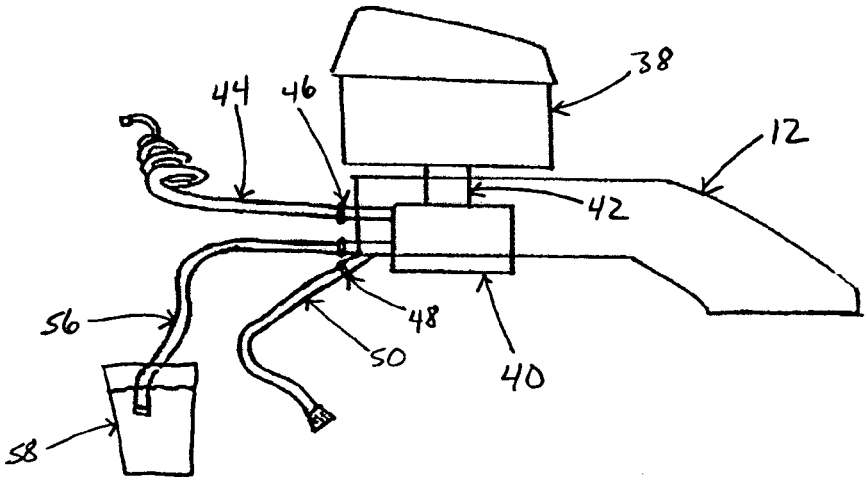
FIG. 2 is a side view of a portion of the power washer.

As shown in FIG. 2, the power washer 10 includes a power source 38, such as a gas engine or electric motor or the like, and a fluid pump 40. The fluid pump typically provides a flow rate between 0.5 gal/min. and 5 gal/min. and pressure between 1,000 psi and 5,000 psi. However, other ranges may be possible. As shown in FIG. 2, the pump 40 is located below the power source 38 and is driven by the power source 38 through a vertical drive housing 42. However, other arrangements are also possible. For example, the pump 40 could be positioned behind the power source 38 and could be driven through a horizontal drive housing. A low pressure hose 44 is connected to the pump inlet 46. Typically, the low pressure hose 44 is connected to a conventional water outlet or faucet to supply water to the power washer 10. Preferably, an elastic, coiled hose is used for the low pressure hose 44 so that the hose will self-coil and uncoil as the operator maneuvers the power washer 10. This provides added convenience by helping to keep the low pressure hose 44 out of the way during maneuvering. However, a regular straight garden hose may also be used. The pump outlet 48 is connected to a high pressure hose 50. As shown in FIG. 1, the high pressure hose 50 is connected to a gun 52, which is described further below. Because the gun 52 normally is not separated from the high pressure hose 50, the gun 52 may be permanently attached to the high pressure hose 50. Typically, the gun may have either a screw type or quick-connect connection between the gun 52 and the high-pressure hose 50. The quick-connect connection may be of the type described below or may be a bayonet type quick-connect connection. Preferably, the high pressure hose 50 is provided as a long length of hose, which may be wrapped in a storage coil as shown in FIG. 1. A basket 54 positioned behind the power source 38 and within the handle 18 may be provided to contain the high pressure hose 50. Alternatively, a hose reel, plastic tray, hook, bracket, hook and loop strap and other means may also be used to store the hose. As described below, a length of at least 5 feet is desirable for the high pressure hose 50 to allow the gun 52 to be used away from the transport frame 12. As further shown in FIG. 2, a pick-up hose 56 is also provided at the pump outlet 48 as a detergent intake. The pick-up hose 56 is typically used to draw detergent or other chemicals 58 into the high pressure hose 50 for dispersion with the water or other fluid pressured by the pump 40, such as a low pressure venturi type system. The power washer 10 may include on-board storage for conventional detergent bottles and containers. The power washer 10 may also be provided with a fixed or removable container that detergents can be poured into. For example, the pick-up hose 56 may be used to conveniently apply detergents out of this container.

Figure 27:
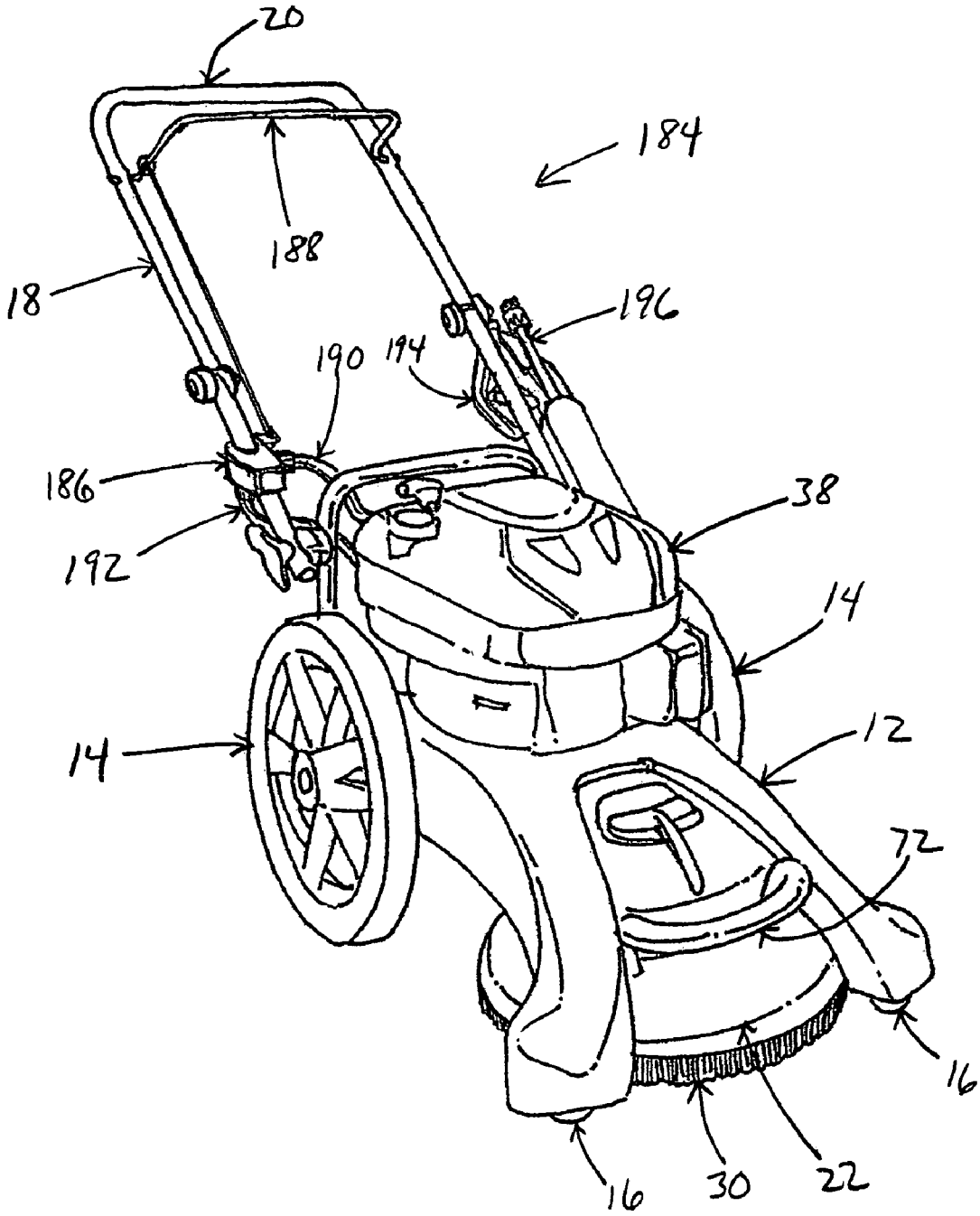
FIG. 27 is a front perspective view of another power washer.

The power washer 10 also includes a gun 52 that may be secured to the handle 18 by clips 60 or other means either above or below the handle 18. The gun 52 includes a conventional fluid valve, or manifold valve, in the handle portion 62 that is controlled by a trigger 64 with child-safety lock-out. Thus, when the trigger 64 is actuated, fluid flows through the valve and the gun 52. However, when the trigger 64 is at rest, fluid flow is blocked and does not flow through the gun 52. Preferably, the gun 52 is positioned on the handle 18 so that the trigger 64 is near the handle grip 20 so that the user can actuate the trigger 64 at the same time the user grasps the handle grip 20. In FIG. 1, a hose 66 secured to the transport frame 12 connects the gun 52 to the wash unit 22. As shown in FIG. 1, a wand 68 may be stored by securing the wand 68 to the power washer handle 18 with clips 70 or other means either above or below the handle 18. The wand 68 may also be stored elsewhere on the power washer 10. Alternatively, the wand 68 may be connected between the gun 52 and the hose 66 which is secured to the transport frame 12. As shown in FIG. 27 and described below, the gun may also be permanently connected to the transport frame with an integral design. The high-pressure hose may be connected to the gun through a quick-connect type connection. The power washer may also be equipped with an additional gun that can be connected to the high-pressure hose and wand for spray, hand wash or vertical hand wash modes.

One feature of the power washer 10 is that the wash unit 22 may be disconnected from the transport frame 12 for use in other modes as described below. For example, as shown in FIG. 6, an operator may separate the wash unit 22 from underneath the transport frame 12. A handle 72 may be provided on the top of the wash unit 22 to allow the operator to grasp the wash unit 22 during separation or for better control while cleaning vertical surfaces. In the arrangement shown in FIGS. 6 and 7, the front wheels 16 of the power washer 10 remain with the transport frame 12 after separation of the wash unit 22. Alternatively, the front wheels 16, 96 could be substituted with feet and wear pads or skids. However, as described further below and shown in FIGS. 13 and 14, the front wheels 96 may be integral with the wash unit 92. As shown in FIG. 7, fluid from the high pressure hose 50 and the hose 66 secured to the frame 12 is preferably supplied to the wash unit 22 through a quick connection 74. This allows the operator to quickly and easily disconnect, and reconnect, the wash unit 22 from the transport frame 12. Other types of connections, such as screw connections or high-pressure bayonet-type connections as sometimes found on electric pressure washers, may also be used.

The quick connection 74 is shown in more detail in FIGS. 8A through 8C. In FIG. 8A, the quick connection 74 is shown disconnected. The quick connection 74 includes a coupler body 76 connected to one hose and a nipple 78 connected to the other hose which is designed to be received by the coupler body 76. The coupler body 76 includes a longitudinally displaceable ring 80 that forces a series of balls inward to lock against a groove 82 in the nipple 78. The balls are released to allow disengagement of the nipple 78 from the coupler body 76 by moving the displaceable ring 80. In order to increase the bending strength of the quick connection 74, a pair of support rings 84, 86 are provided. The coupler support ring 84 is attached to the coupler body 76 behind the displaceable ring 80. The nipple support ring 86 is attached to the nipple 78 behind the ball receiving groove 82. Preferably, the coupler support ring 84 is rigidly attached to the coupler body 76, and the nipple support ring 86 is threadably attached to the nipple 78. In FIG. 8B, the quick connection 74 is shown partially connected, with the nipple 78 connected to the coupler body 76 to form a coupling. In FIG. 8C, the nipple support ring 86 is shown in the connected configuration. In this configuration, the nipple support ring 86 is tightened by threading the nipple support ring 86 toward the coupler support ring 84 until the two support rings 84, 86 abut against each other. Thus, in the connected configuration, the nipple support ring 86 encompasses the nipple 78 and the coupler body 76 to provide extra strength to the connection.

As shown in FIGS. 9 through 12, the power washer 10 may be used in multiple modes to make the power washer 10 more versatile than a single use type washer. Preferably, quick connections 74 like that shown in FIGS. 8A-8C may be used throughout the power washer 10 to make it easier to switch between each of the possible modes. One of the advantages of the multiple modes described below is that a single high pressure valve controlled by the gun trigger 64 may be used for all of the described modes. This decreases costs and simplifies operation of the power washer 10.

In FIG. 9, the power washer 10 is shown in a walk-behind mode. In this mode, the wash unit 22 is connected to the transport frame 12. High pressure fluid is supplied from the pump 40 to the gun 52 which is secured to the handle 18. Preferably, the handle portion 62 and trigger 64 of the gun 52 are positioned adjacent to the handle grip 20 to make it easy for the operator to actuate the trigger 64 while pushing on the handle 18. The fluid is then supplied to the wash unit 22 through the hose 66 secured to the transport frame 12. Alternatively, the wand 68 could be connected between the gun 52 and the hose 66 secured to the transport frame 12 if desired. Accordingly, in the walk-behind mode, the operator cleans the wash surface by rolling the transport frame 12 and wash unit 22 over the wash surface. In general, this mode is preferred when cleaning large horizontal surfaces.

Figure 10:
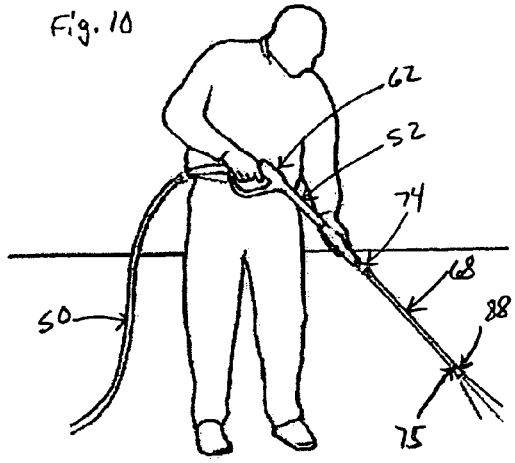
FIG. 10 is a perspective view of the power washer, showing the gun being used with a wand and a nozzle.

In FIG. 10, the power washer 10 is shown in a spray mode. In this mode, the gun 52 is disconnected from the hose 66 secured to the transport frame 12 and is connected to the wand 68. A spray nozzle 88 is connected to the opposing end of the wand 68. Preferably, quick connections 74 are used between the gun 52 and the wand 68 and between the wand 68 and the nozzle 88. Accordingly, in the spray mode, the operator cleans surfaces by waving the gun 52 in the direction where spray from the nozzle 88 is desired. In this mode, the operator generally works away from the transport frame 12, and the transport frame 12 functions generally as a base unit to supply high pressure fluid to the gun 52. Thus, the transport frame 12 only needs to be moved when the operator moves to a new area outside the reach of the high pressure hose 50.

Figure 11:
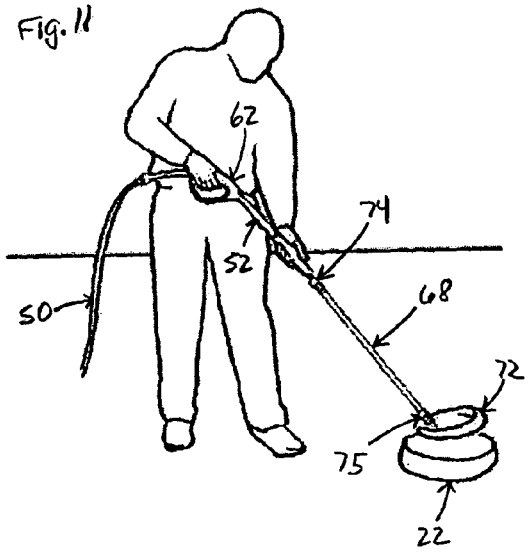
FIG. 11 is a perspective view of the power washer, showing the gun being used with the wand and the washer unit.

In FIG. 11, the power washer 10 is shown in a hand wash mode. In this mode, the wash unit 22 is disconnected from the transport frame 12 and is connected to the wand 68 opposite from the gun 52. A quick connection 74 between the wand 68 and the wash unit 22 that is compatible with the quick connection 74 between the transport frame 12 and the wash unit 22 is preferred. Accordingly, in the hand wash mode, the operator cleans surfaces by moving the gun 52 to direct the wash unit 22 to areas to be washed. In general, this mode is preferred when cleaning smaller areas where more precise control is desired or elevated areas when it is difficult to lift the power washer 10, such as stairs, decks, etc.

Figure 12:
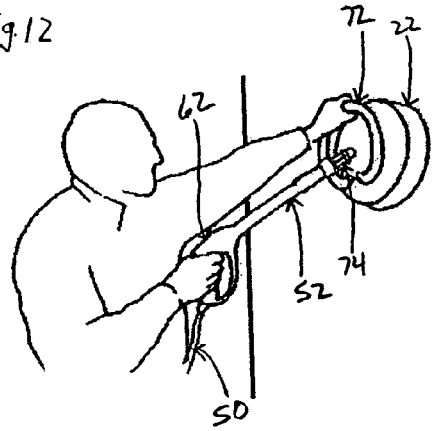
FIG. 12 is a perspective view of the power washer, showing the gun being used with the wash unit without using the wand.

In FIG. 12, the power washer 10 is shown in a vertical hand wash mode. In this mode, the gun 52 is connected directly to the wash unit 22 without the wand 68 being connected between the gun 52 and the wash unit 22. Thus, this mode is similar to the hand wash mode described above but places the wash unit 22 closer to the handle portion 62 of the gun 52. As shown, this mode is generally useful when cleaning vertical surfaces since the operator can grasp the handle 62 on the wash unit 22 at the same time that the operator controls the gun 52. If desired, the gun 52 and the wash unit 22 may have different quick connections 74, 75 that are incompatible with each other. This may be useful to prevent the user from directly connecting the gun 52 to the wash unit 22 if a specified distance between the gun handle 62 and the wash unit 22 is desired. Thus, one alternative to the operating mode shown in FIG. 12 would be to provide a shorter wand than the wand 68 shown in FIG. 11 to allow the gun handle 62 to be positioned closer to the wash unit 22 but at a specified distance from the wash unit 22. Additional, multiple or telescoping spray wand extensions may also be connected between the gun 52 and wash unit 22 in order to reach higher vertical surfaces, such as second story exteriors of a house. The spray wand extensions may be connected through quick-connections, such as the one described above or bayonet-types, or screw-type connections.

Figure 13:
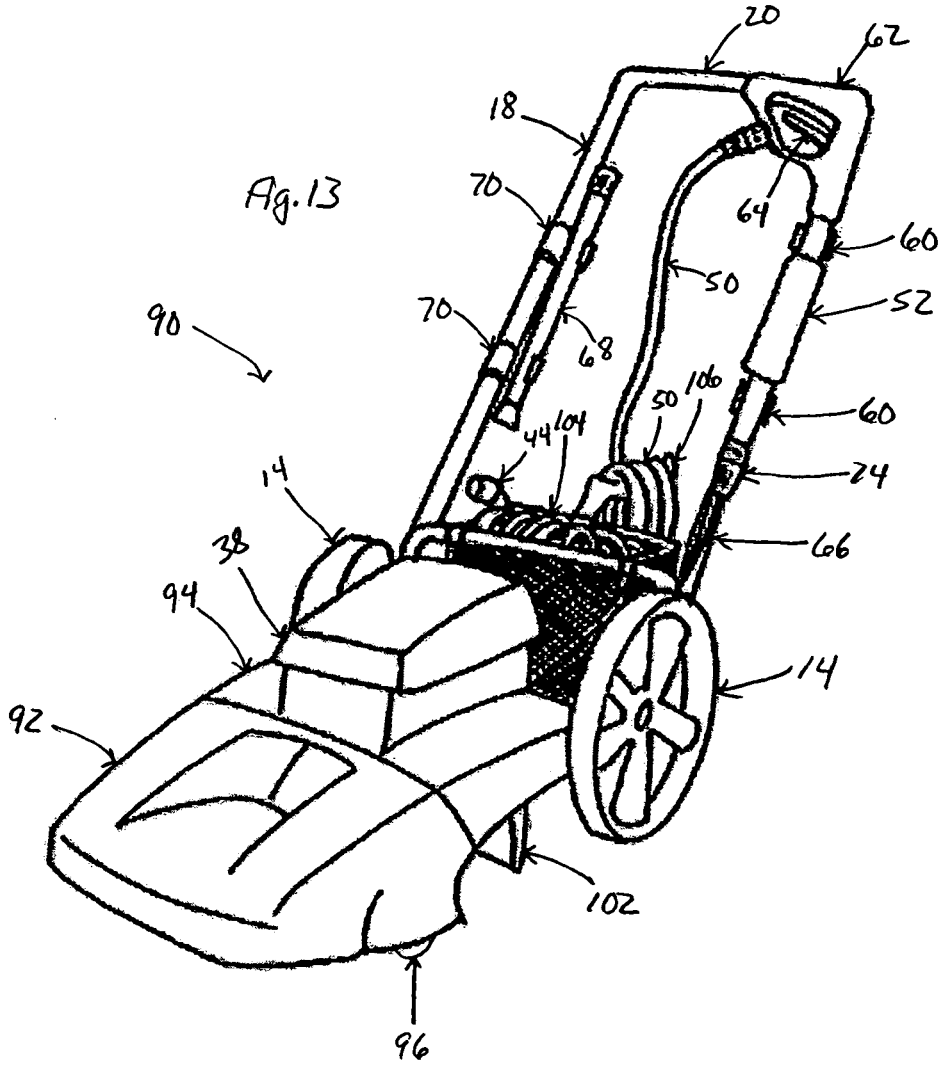
FIG. 13 is a perspective view of another embodiment of the power washer.
Figure 14:
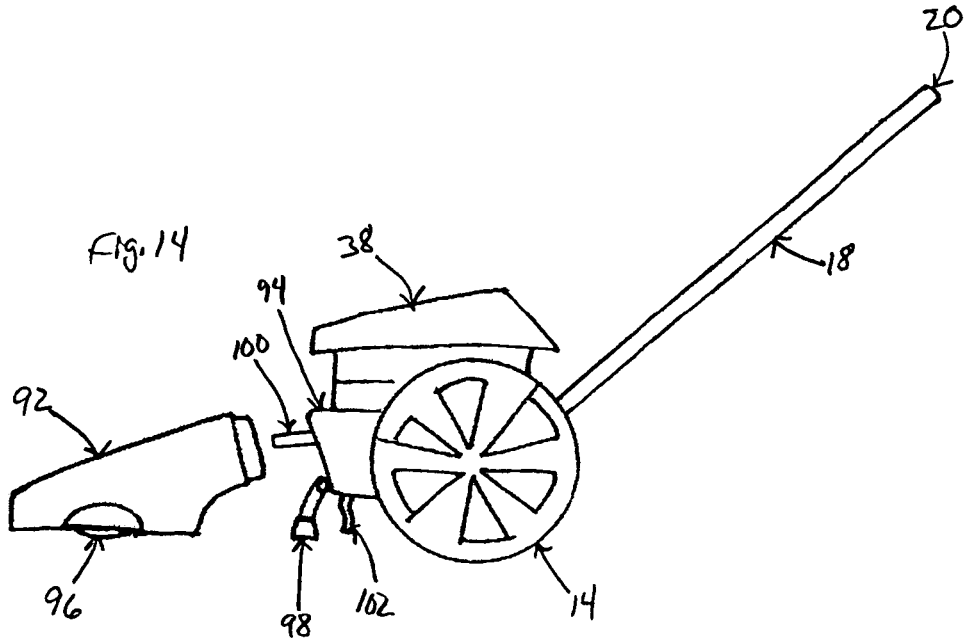
FIG. 14 is a side view of the power washer shown in FIG. 13, showing the wash unit separated from the transport frame.

In FIGS. 13 and 14, another embodiment of a power washer 90 is shown. The power washer 90 that is shown in FIGS. 13 and 14 is similar to the power washer 10 described above, and thus, only those features that are different are described here. In this embodiment, the wash unit 92 is disconnected from the transport frame 94 by sliding the wash unit 92 forward away from the power source 38. The front wheels 96 remain with the wash unit 92 instead of remaining with the transport frame 94. In order to maintain the transport frame 94 in an upright position after disconnecting the wash unit 92, a forwardly positioned support foot 98 may be provided on the transport frame 94. The support foot 98 may be hingedly attached to the transport frame 94. Alternatively, the support foot 98 may be positioned so that the bottom of the foot 98 is a small distance above the ground when the wash unit 92 is connected to the transport frame 94. Then, when the wash unit 92 is separated from the transport frame 94, the forward part of the transport frame 94 will drop a short distance until the bottom of the support foot 98 contacts the ground. The power washer 90 shown in FIGS. 13 and 14 may be desirable where a larger wash unit 92 is used which may be more difficult to control in the hand wash modes. Because the front wheels 96 are integral with the wash unit 92, the hand wash modes may be easier to perform since the front wheels 96 can be used to roll the wash unit 92 over the wash surfaces. Other advantages of integrating the front wheels 96 with the wash unit 92 may also be possible.

In addition, as shown in FIG. 14, the wash unit 92 may be connected to the transport frame 94 on rails 100. If desired, the forward position of the wash unit 92 may be adjustable by adjusting the rails 100 while the wash unit 92 is connected to the transport frame 94. As a result, the operator may optimize maneuverability of the power washer 90 in the walk-behind mode by changing the forward position of the wash unit 92 if desired.

A squeegee 102 may also be provided behind the wash unit 92 if desired. The squeegee 102 is preferably made from rubber or an elastomeric material. The squeegee 102 may be helpful to push fluid on the wash surface off to the sides when the operator pushes the power washer 90 forward in the walk-behind mode. The squeegee may also be connected to the wash unit. In FIG. 13, an alternative arrangement for the hoses 44, 50 is also shown. As shown, the low pressure, coiled hose 44 may be placed in a bag 104 within the handle 18. The high pressure hose 50 may then be wrapped around a rearwardly extending hook 106. The hook 106 may be collapsible or foldable for quick removal of the hose 44.

Figure 15:
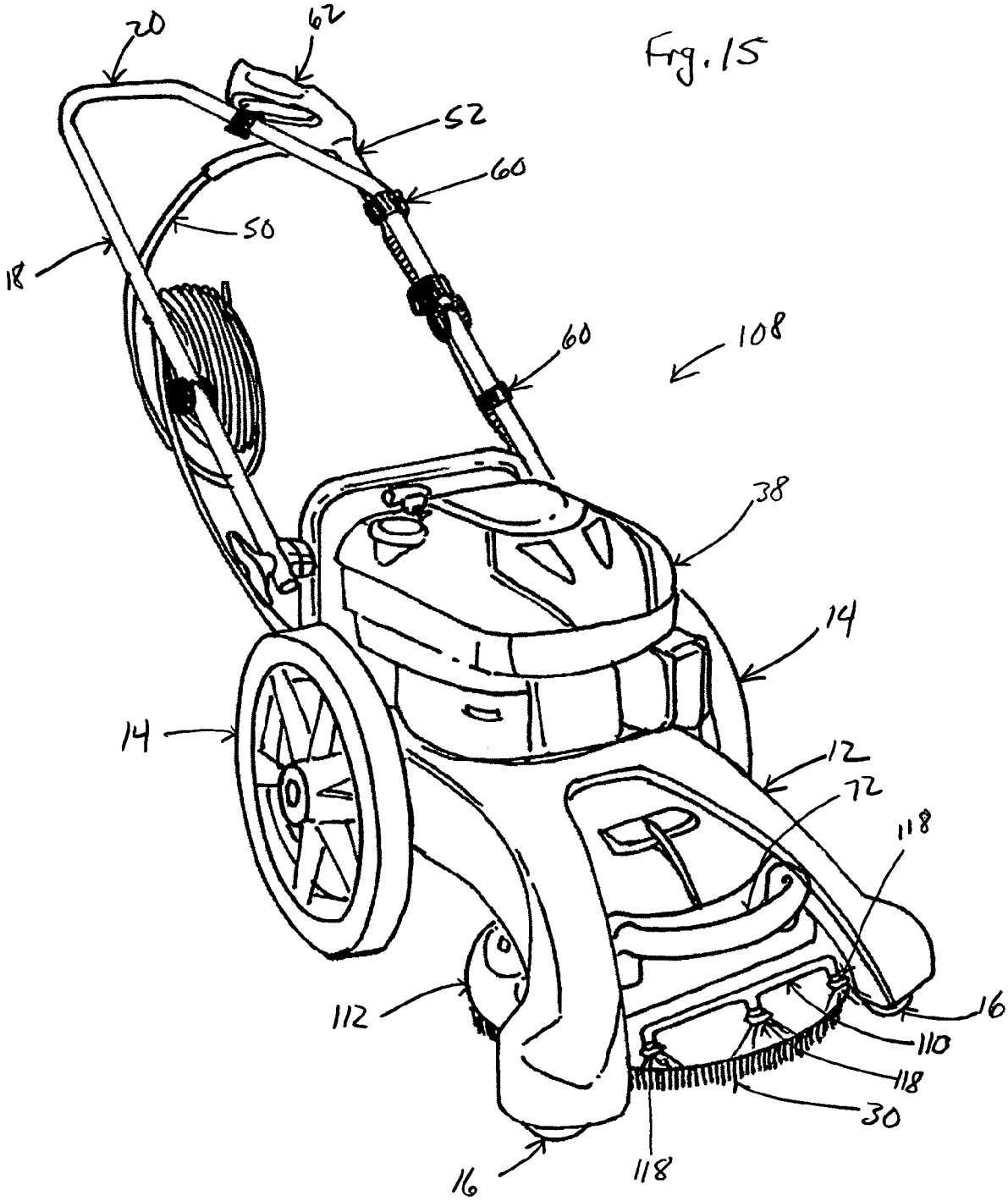
FIG. 15 is a perspective view of a power washer, showing a fixed spray bar.

In FIGS. 15-20B, a number of wash units are shown with fixed spray bars. In FIG. 15, an embodiment of a power washer 108 is shown with a fixed spray bar 110 included in the wash unit 112. For clarity, the spray bar 110 in FIG. 15 is shown through the cover 114 of the wash unit 112 although it is understood that the spray bar 110 is positioned underneath the cover 114.

Figure 18A:
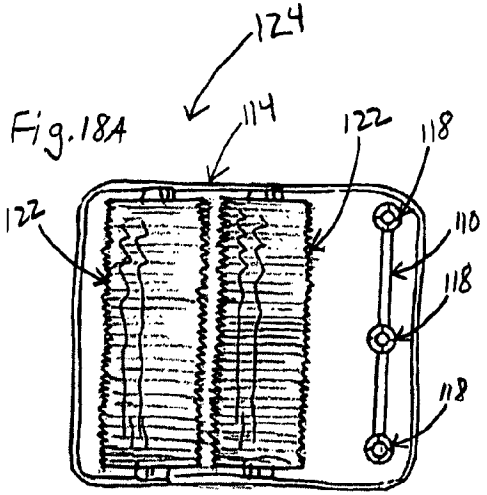
FIG. 18A is a top view of a wash unit, showing a fixed spray bar and two roller scrubbing brushes.
Figure 18B:
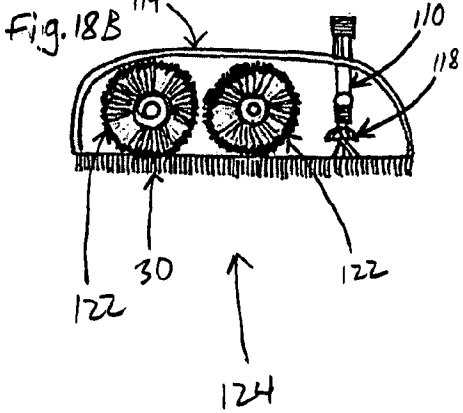
FIG. 18B is a side view of the wash unit in FIG. 18A, showing the fixed spray bar and the two roller scrubbing brushes.
Figure 17A:
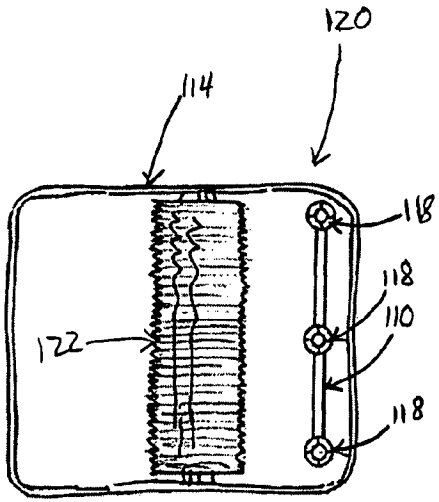
FIG. 17A is a top view of a wash unit, showing a fixed spray bar and a roller scrubbing brush.
Figure 17B:
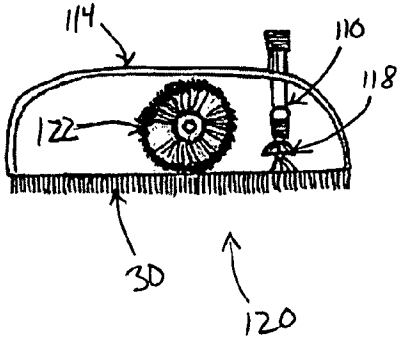
FIG. 17B is a side view of the wash unit in FIG. 17A, showing the fixed spray bar and the roller scrubbing brush.
Figure 16A:
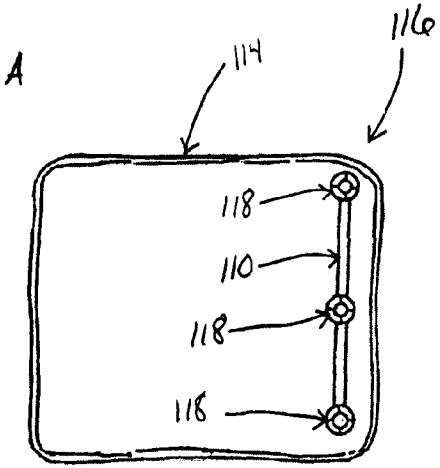
FIG. 16A is a top view of a wash unit, showing a fixed spray bar.
Figure 16B:
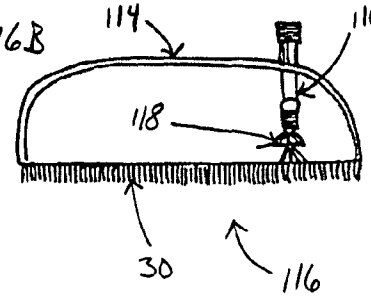
FIG. 16B is a side view of the wash unit in FIG. 16A, showing the fixed spray bar.

In FIGS. 16A and 16B, the wash unit 116 is shown with a fixed spray bar 110 extending laterally across the width of the wash unit 116. The spray bar 110 may have three high pressure nozzles 118, as shown, or may have any other number of nozzles as desired. In FIGS. 16A and 16B, the wash unit 116 is provided only with the fixed spray bar 110 and without any other cleaning apparatus. In FIGS. 17A and 17B, the wash unit 120 is shown with a roller scrubbing brush 122 that contacts the wash surface to provide additional cleaning. As shown, the axis of rotation of the roller scrubbing brush 122 is parallel to the wash surface. In FIGS. 18A and 18B, the wash unit 124 is shown with two roller scrubbing brushes 122 behind the fixed spray bar 110. The roller scrubbing brushes 122 may be the same as each other or may be different from each other to complement the cleaning effect of each roller scrubbing brush 122. It is generally preferred that rotation of the roller scrubbing brushes 122 in FIGS. 17A-18B be powered by the power source 38.

Figure 20A:
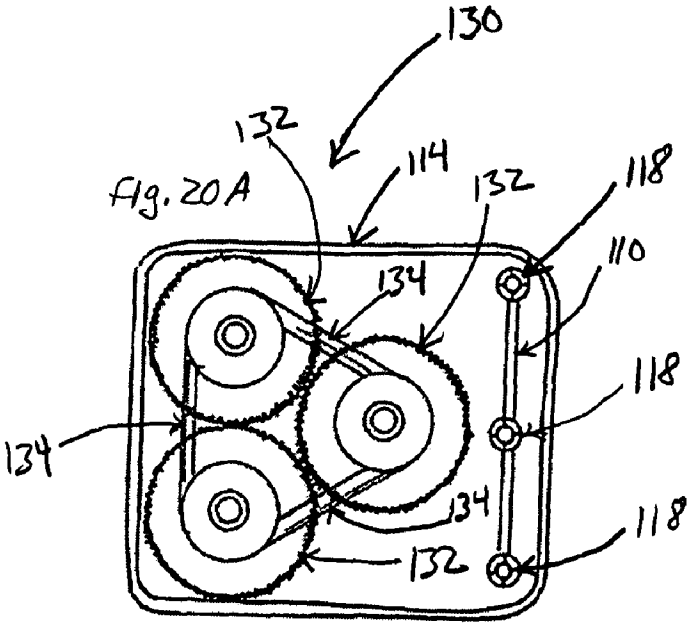
FIG. 20A is a top view of a wash unit, showing a fixed spray bar and three larger disk type rotating brushes.
Figure 20B:
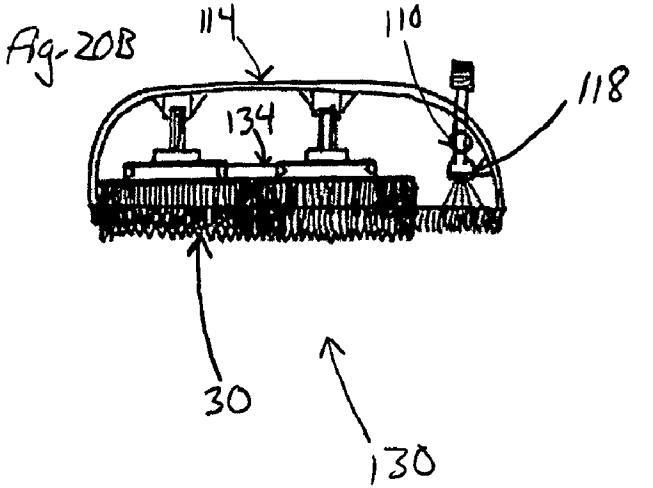
FIG. 20B is a side view of the wash unit in FIG. 20A, showing the fixed spray bar and the three larger disk type rotating brushes.
Figure 19A:
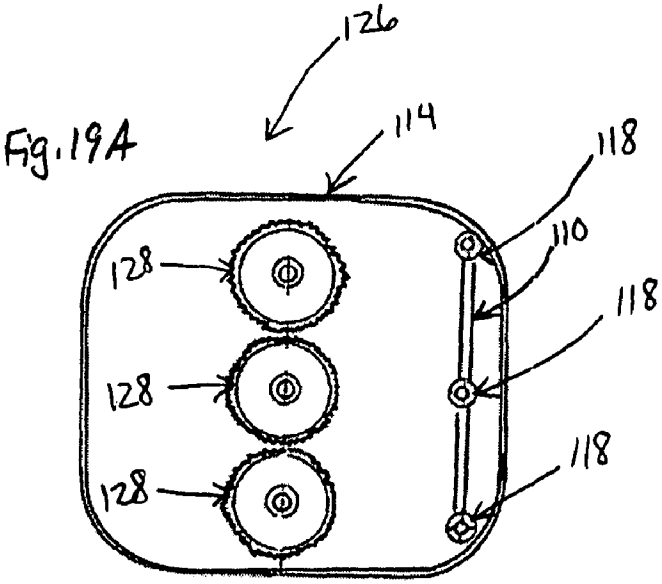
FIG. 19A is a top view of a wash unit, showing a fixed spray bar and three disk type rotating brushes.
Figure 19B:
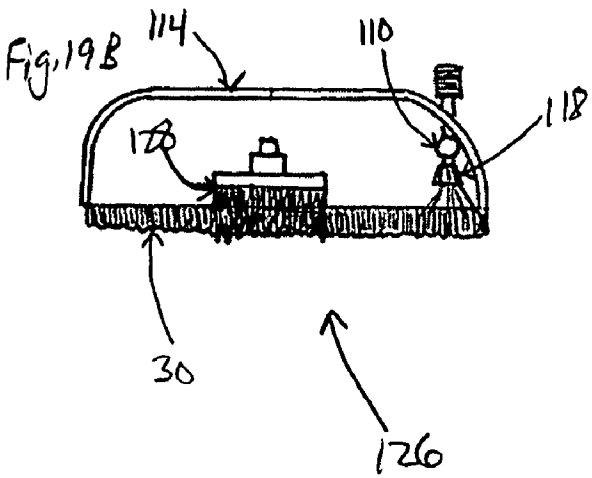
FIG. 19B is a side view of the wash unit in FIG. 19A, showing the fixed spray bar and the three disk type rotating brushes.

In FIGS. 19A and 19B, the wash unit 126 is shown with three disk type rotating brushes 128. As shown, the three disk type rotating brushes 128 are positioned adjacent each other so that the three disk type rotating brushes 128 extend across the width of the wash unit 126. The axis of rotation of the disk type rotating brushes 128 is perpendicular to the wash surface. In FIGS. 20A and 20B, the wash unit 130 is shown with three larger disk type rotating brushes 132 positioned to provide a transverse overlap of the brushing surface. Preferably, the rotation of the disk type rotating brushes 132 in FIGS. 19A-20B are powered by the power source 38. As shown in FIG. 20A, the three disk type rotating brushes 132 may be interconnected with a drive belt 134 or other drive mechanism. As result, only one of the brushes 132 needs to be directly powered by the power source 38, since the directly powered brush 132 will power the other brushes 132 through the drive belt 134. The wash units may also have other numbers or groupings of brushes as desired.

Figures 22, 23:
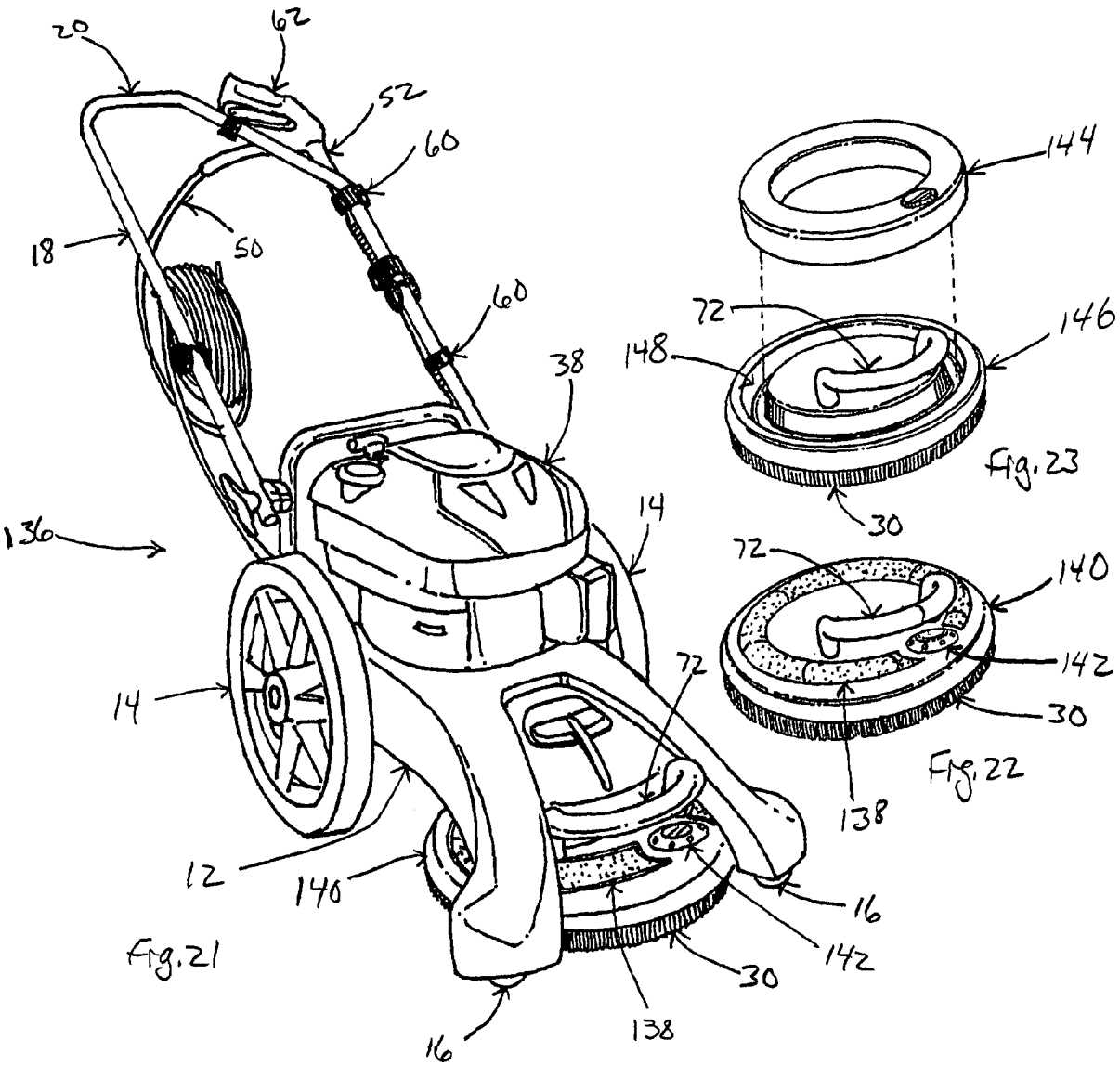
FIG. 22 is a perspective view of a wash unit, showing an integrated detergent tank.
FIG. 23 is a perspective view of a wash unit, showing a removable detergent tank.

In FIGS. 21-23, the power washer 136 is shown with a detergent tank on the wash unit. As shown in FIG. 22, the detergent tank 138 may be made integral with the wash unit 140, such as with a double wall system. A metering valve 142 may also be provided to regulate the amount of detergent that flows to the wash unit 140. As shown in FIG. 23, the detergent tank 144 may also be removable from the wash unit 146 for refilling or to allow the wash unit 146 to be used without the detergent tank 144. The detergent tank 144 may also wrap around the top of the wash unit 146 in a circular fashion to evenly distribute the weight. Preferably, the wash unit 146 is provided with a ring cavity 148 along the top side of the wash unit 146. The ring cavity 148 is designed to match the shape of the detergent tank 144 to allow the ring cavity 148 to receive the detergent tank 144. The detergent intake valve may be controlled by a pressure differential caused by fluid flow through the power washer when the gun 52 is opened and closed or may be controlled by the rotation of the spray bar or controlled in any other manner well known in the art.

In FIG. 24, the power washer 150 is shown with a handle 152 that is adjustable in height. As shown, a joint 154 is provided near the rear side of the power source 38. The joint 154 allows the height of the transverse handle grip 156 to be adjusted to suit the desired height of various users. The handle may also telescope to accommodate the height of the user. In FIG. 25, the handle 152 is shown with a double fold feature that allows the handle 152 to be folded on top of the power source 38 for compact storage. As shown, the handle 152 includes two joints 154, 160. The lower joint 154 is located behind the power source 38 near the rear wheels 14. The lower joint 154 allows the lower portion 162 of the handle 152 to fold forward over the wash unit 164. The upper joint 160 allows the upper portion 166 of the handle 152 to fold rearward on top of the lower portion 162 of the handle 152. As shown, it is preferable in this embodiment for the gun 52 to be attached to the top side of the handle 152 to permit the handle 152 to be folded without interference from the gun 52. However, as shown in FIG. 15, the gun 52 may also be attached to the bottom side of the handle 18. The handle 18 may also fold with only a single joint or may be removable for storage.

Figure 26B:
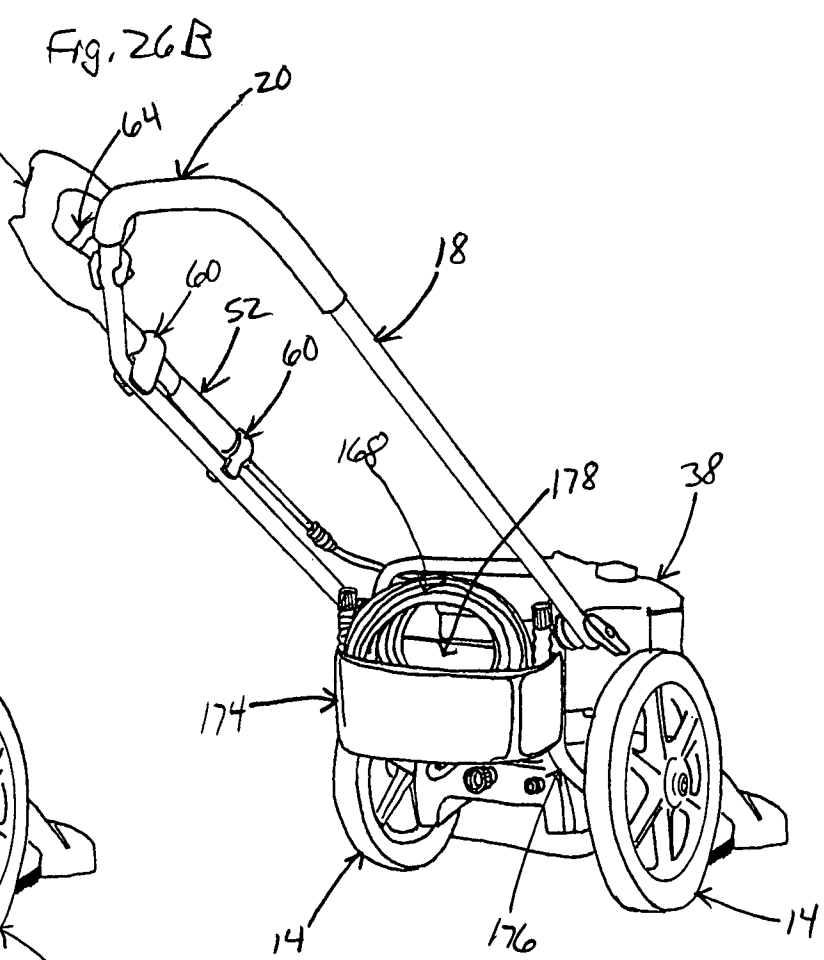
FIG. 26B is a rear perspective view of the power washer, showing a hard tray for storing a hose.
Figure 26A:
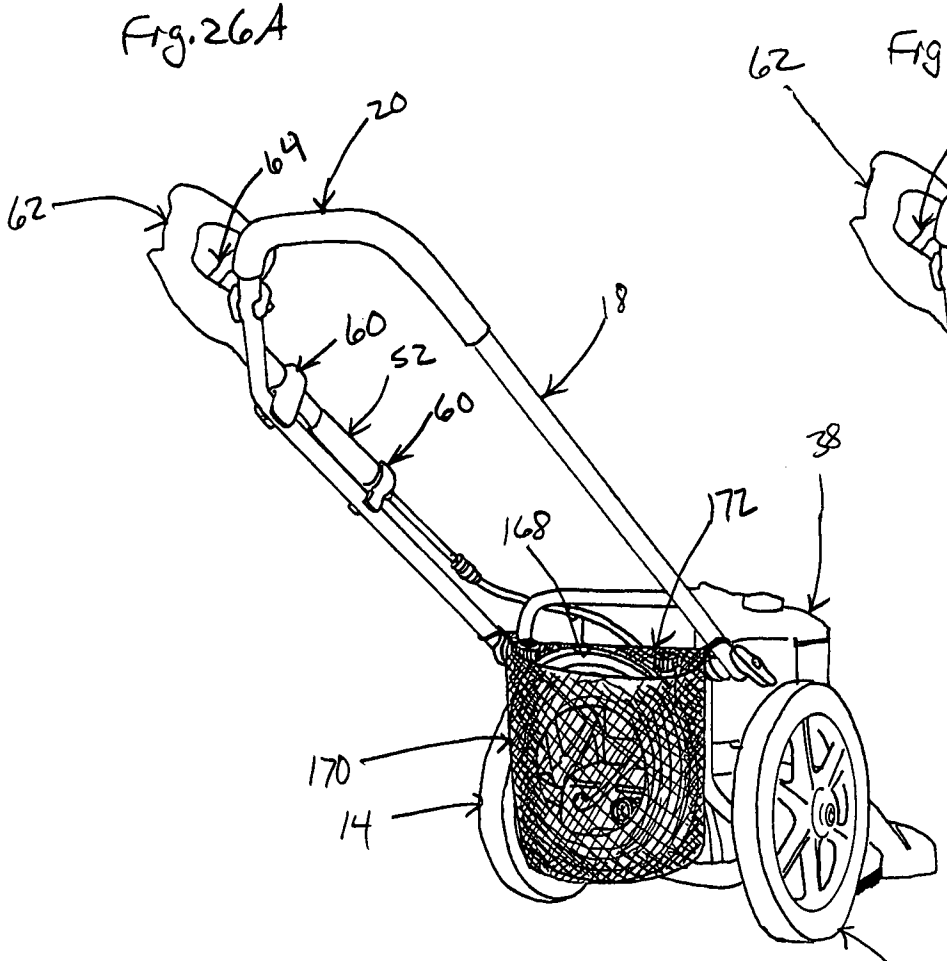
FIG. 26A is a rear perspective view of the power washer, showing a soft basket for storing a hose.
Figure 26D:
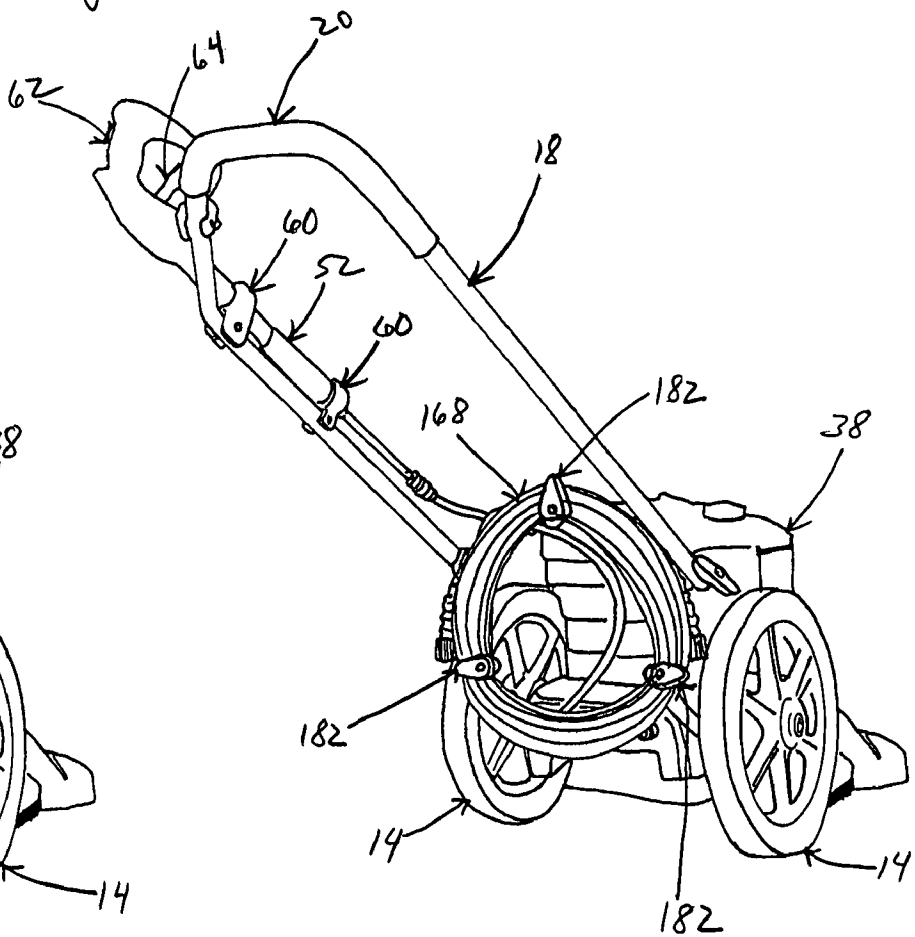
FIG. 26D is a rear perspective view of the power washer, showing a series of hooks on a fixed portion of the frame for hanging and/or wrapping a hose.
Figure 26C:
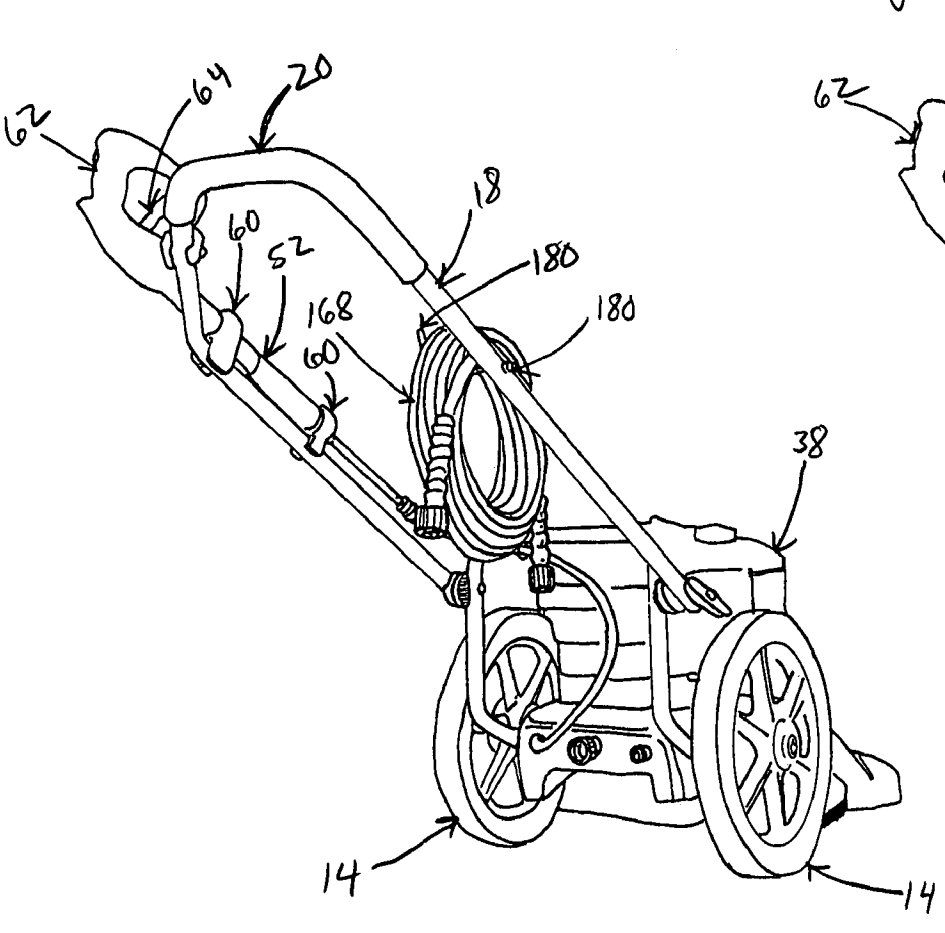
FIG. 26C is a rear perspective view of the power washer, showing a hook on the handle for hanging a hose.

In FIGS. 26A-26D several storage arrangements are shown for storing a high pressure hose 168 and/or a low pressure hose 168. As shown in FIG. 26A, a soft basket 170 may be attached to the handle 18 behind the power source 38. An opening 172 is provided at the top of the basket 170 for placing the hose 168 in the basket 170 and retrieving the hose 168. As shown in FIG. 26B, a hard tray 174 may be attached to a fixed portion 176 of the frame 12 behind the power source 38. An opening 178 is provided at the top of the tray 174 for placing the hose 168 in the tray 174 and retrieving the hose 168. As shown in FIG. 26C, a hook 180 may be provided on the handle 18 for hanging the hose 168. As shown in FIG. 26D, a series of hooks 182 may be provided on the fixed portion 176 of the frame 12 behind the power source 38 for hanging and/or wrapping the hose 168.

In FIG. 27 another alternative embodiment of a power washer 184 is shown. As shown, the gun is replaced with an integral control valve 186. The control valve 186 may be opened and closed with a control lever 188 near the handle grip 20. The high pressure hose 190 from the pump 40 is connected to the control valve 186, and the high pressure hose 192 connected to the wash unit 22 is also connected to the control valve 186. Preferably, the high pressure hose 190 from the pump 40 is connected to the control valve 186 with a quick-connect connection. This allows the high pressure hose 190 from the pump 40 to be easily disconnected from the control valve 186. A gun 194 like that described above may be stored on the power washer 184 along with a wand 196. The high pressure hose 190 from the pump 40 may then be connected to the gun 194 in order to use the power washer 184 in other modes of operation as described above.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

We claim:

1. A power washer configurable into at least two distinct modes of operation, comprising:

a transport frame comprising a first wheel, a power source, a fluid pump, and a handle, said transport frame being maneuverable by engaging said handle to roll said transport frame on said first wheel;

a gun attached to said transport frame and fluidly connected to said fluid pump in a first mode of operation, said fluid pump thereby supplying pressurized fluid to said gun, said gun operable to block fluid flow from said fluid pump and being actuable to allow fluid to flow from said gun;

a wash unit attached to said transport frame independently from said gun and adapted to be fluidly connected to said gun in said first mode of operation while said wash unit is attached to said transport frame, said wash unit comprising a first nozzle adapted to spray fluid onto a wash surface; and wherein said gun is detachable from said transport frame and is adapted to be fluidly disconnected from said wash unit in a second mode of operation.

2. The power washer according to claim 1, further comprising a wand adapted to be fluidly connected at a first end to said gun in said second mode of operation.

3. The power washer according to claim 2, further comprising a second nozzle adapted to be fluidly connected to said wand at a second end in a third mode of operation.

4. The power washer according to claim 2, wherein said wash unit is detachable from said transport frame and is adapted to be fluidly connected to said wand at a second end in a third mode of operation.

5. The power washer according to claim 1, wherein said wash unit is detachable from said transport frame and is adapted to be fluidly connected to said gun with a direct connection between said gun and said wash unit in a third mode of operation.

6. The power washer according to claim 1, wherein said handle comprises a transverse handle grip and said gun comprises a trigger, said gun being attached to said transport frame in said first mode of operation with said trigger disposed adjacent said transverse handle grip, whereby said trigger is actuable by grasping said transverse handle grip in said first mode of operation.

7. The power washer according to claim 1, wherein said wash unit comprises a fixed spray bar comprising at least one of said first nozzle.

8. The power washer according to claim 7, wherein said wash unit further comprises a roller scrubbing brush.

9. The power washer according to claim 8, wherein said wash unit further comprises two of said roller scrubbing brushes.

10. The power washer according to claim 7, wherein said wash unit further comprises a disk type rotating brush.

11. The power washer according to claim 10, wherein said wash unit further comprises three of said disk type rotating brushes.

12. The power washer according to claim 11, wherein one of said disk type rotating brushes is powered by said power source and others of said disk type rotating brushes are powered by said one disk type rotating brush.

13. The power washer according to claim 1, further comprising a quick connection between said gun and said transport frame.

14. The power washer according to claim 13, wherein said quick connection comprises a coupling and a support ring.

15. The power washer according to claim 1, wherein said handle comprises at least a first joint and a second joint, a lower portion of said handle being rotatable forward around said first joint and an upper portion of said handle being rotatable rearward around said second joint, said handle thereby being foldable generally above said wash unit, said gun being attached to a top side of said upper portion of said handle.

16. The power washer according to claim 1, wherein said transport frame further comprises a soft basket disposed behind said power source, said soft basket adapted to contain a hose.

17. The power washer according to claim 1, wherein said transport frame further comprises a hard tray fixedly attached thereto and disposed behind said power source, said hard tray adapted to contain a hose.

18. The power washer according to claim 1, wherein said transport frame further comprises a hook attached to said handle, said hook adapted to hang a hose.

19. The power washer according to claim 1, wherein said transport frame further comprises a hook fixedly attached thereto and disposed behind said power source, said hook adapted to hang a hose.

20. The power washer according to claim 1, further comprising a wand adapted to be fluidly connected at a first end to said gun in said second mode of operation, a second nozzle adapted to be fluidly connected to said wand at a second end in said second mode of operation, wherein said wash unit is detachable from said transport frame and is adapted to be fluidly connected to said wand at said second end in a third mode of operation.

21. The power washer according to claim 20, wherein said wash unit is adapted to be fluidly connected to said gun with a direct connection between said gun and said wash unit in a fourth mode of operation.

22. The power washer according to claim 20, wherein said handle comprises a transverse handle grip and said gun comprises a trigger, said gun being attached to said transport frame in said first mode of operation with said trigger disposed adjacent said transverse handle grip, whereby said trigger is actuable by grasping said transverse handle grip in said first mode of operation.

23. The power washer according to claim 20, wherein said wash unit comprises a fixed spray bar comprising at least one of said first nozzle.

24. The power washer according to claim 23, wherein said wash unit further comprises a roller scrubbing brush.

25. The power washer according to claim 24, wherein said wash unit further comprises two of said roller scrubbing brushes.

26. The power washer according to claim 23, wherein said wash unit further comprises a disk type rotating brush.

27. The power washer according to claim 26, wherein said wash unit further comprises three of said disk type rotating brushes.

28. The power washer according to claim 27, wherein one of said disk type rotating brushes is powered by said power source and others of said disk type rotating brushes are powered by said one disk type rotating brush.

29. The power washer according to claim 20, further comprising a quick connection between said gun and said transport frame.

30. The power washer according to claim 29, wherein said quick connection is compatible with said first end of said wand and further comprising another quick connection at said second end of said wand, said another quick connection being compatible with said wash unit, said quick connection and said another quick connection being incompatible with each other to prevent said gun from being directly connected to said wash unit.

31. The power washer according to claim 29, wherein said quick connection comprises a coupling and a support ring.

32. The power washer according to claim 20, wherein said transport frame comprises a second wheel fixedly attached thereto, said transport frame being maneuverable in said first mode of operation by rolling said transport frame on said second wheel, said second wheel being detachable from said transport frame with said wash unit.

33. The power washer according to claim 32, wherein said transport frame comprises a support foot adapted to contact a surface and support a forward portion of said transport frame when said wash unit is detached from said transport frame.

34. The power washer according to claim 20, wherein said first wheel comprises two rear wheels and further comprising two second wheels fixedly attached to a forward portion of said transport frame, said second wheels adapted to support said forward portion of said transport frame when said wash unit is detached from said transport frame.

35. The power washer according to claim 20, wherein said wash unit comprises a handle engageable to maneuver said wash unit when said wash unit is detached from said transport frame.

36. The power washer according to claim 20, further comprising a detergent intake adapted to supply detergent to said fluid sprayed from said wash unit in said first mode of operation.

37. The power washer according to claim 36, further comprising a detergent tank attached to said wash unit and detachable therefrom, said wash unit comprising a mating cavity adapted to receive said detergent tank.

38. The power washer according to claim 36, further comprising a detergent tank integrated into said wash unit.

39. The power washer according to claim 20, wherein said handle comprises a first joint disposed adjacent said power source, said handle being pivotable about said first joint, a height of a transverse handle grip thereby being adjustable.

40. The power washer according to claim 20, wherein said handle comprises at least a first joint and a second joint, a lower portion of said handle being rotatable forward around said first joint and an upper portion of said handle being rotatable rearward around said second joint, said handle thereby being foldable generally above said wash unit, said gun being attached to a top side of said upper portion of said handle.

41. A power washer configurable into at least two distinct modes of operation, comprising:

a transport frame comprising a first wheel, a power source, a fluid pump, and a handle, said transport frame being maneuverable by engaging said handle to roll said transport frame on said first wheel;

a gun attached to said transport frame and fluidly connected to said fluid pump in a first mode of operation, said fluid pump thereby supplying pressurized fluid to said gun, said gun operable to block fluid flow from said fluid pump and being actuable to allow fluid to flow from said gun;

a wash unit attached to said transport frame and adapted to be fluidly connected to said gun in said first mode of operation, said wash unit comprising a first nozzle adapted to spray fluid onto a wash surface;

wherein said gun is detachable from said transport frame and is adapted to be fluidly disconnected from said wash unit in a second mode of operation; and wherein said wash unit comprises a rotating spray bar comprising at least one of said first nozzle.

42. The power washer according to claim 41, wherein said rotating spray bar comprises at least two of said first nozzles, said first nozzles being angled relative to said wash surface.

43. The power washer according to claim 42, wherein said wash unit comprises a cover enveloping said rotating spray bar, said rotating spray bar being adjustable in height relative to said cover and said wash surface.

44. A power washer configurable into at least two distinct modes of operation, comprising:

a transport frame comprising a first wheel, a power source, a fluid pump, and a handle, said transport frame being maneuverable by engaging said handle to roll said transport frame on said first wheel;

a gun attached to said transport frame and fluidly connected to said fluid pump in a first mode of operation, said fluid pump thereby supplying pressurized fluid to said gun, said gun operable to block fluid flow from said fluid pump and being actuable to allow fluid to flow from said gun;

a wash unit attached to said transport frame and adapted to be fluidly connected to said gun in said first mode of operation, said wash unit comprising a first nozzle adapted to spray fluid onto a wash surface;

wherein said gun is detachable from said transport frame and is adapted to be fluidly disconnected from said wash unit in a second mode of operation;

a wand adapted to be fluidly connected at a first end to said gun in said second mode of operation;

a second nozzle adapted to be fluidly connected to said wand at a second end in said second mode of operation;

wherein said wash unit is detachable from said transport frame and is adapted to be fluidly connected to said wand at the second end in a third mode of operation; and wherein said wash unit comprises a rotating spray bar comprising at least two of said first nozzles, said first nozzles being angled relative to said wash surface.

45. The power washer according to claim 44, wherein said wash unit comprises a cover enveloping said rotating spray bar, said rotating spray bar being adjustable in height relative to said cover and said wash surface.

* * * * *